US011236756B2

(12) United States Patent
Smith et al.

(10) Patent No.: US 11,236,756 B2
(45) Date of Patent: Feb. 1, 2022

(54) CAVITATION DEVICE

(71) Applicant: Highland Fluid Technology, Inc., Houston, TX (US)

(72) Inventors: Kevin W. Smith, Bellaire, TX (US); Jeff Fair, Houston, TX (US)

(73) Assignee: Highland Fluid Technology, Inc., Houston, TX (US)

( * ) Notice: Subject to any disclaimer, the term of this patent is extended or adjusted under 35 U.S.C. 154(b) by 648 days.

(21) Appl. No.: 15/221,878

(22) Filed: Jul. 28, 2016

(65) Prior Publication Data

US 2016/0339400 A1 Nov. 24, 2016

Related U.S. Application Data

(63) Continuation-in-part of application No. 14/715,160, filed on May 18, 2015, now Pat. No. 10,258,944.

(60) Provisional application No. 62/197,862, filed on Jul. 28, 2015.

(51) Int. Cl.

| | |
|---|---|
| ***B01F 5/12*** | (2006.01) |
| ***B01F 3/04*** | (2006.01) |
| ***F04D 29/40*** | (2006.01) |
| ***F04D 29/02*** | (2006.01) |
| ***F04D 29/18*** | (2006.01) |
| ***F04D 3/02*** | (2006.01) |
| ***B01F 7/00*** | (2006.01) |

(Continued)

(52) U.S. Cl.

CPC ..... *F04D 29/026* (2013.01); *B01F 7/00491* (2013.01); *B01F 7/00641* (2013.01); *B01F 7/00816* (2013.01); *B01F 7/10* (2013.01); *B01F 7/26* (2013.01); *F04D 3/02* (2013.01); *F04D 29/18* (2013.01); *F04D 29/406* (2013.01)

(58) Field of Classification Search

CPC ..... B01F 7/00816; B01F 2003/04226; B01F 3/04539; B01J 19/008; B01D 19/0094

See application file for complete search history.

(56) References Cited

U.S. PATENT DOCUMENTS

| | | | |
|---|---|---|---|
| 3,487,784 | A | 1/1970 | Rafferty |
| 4,335,994 | A | 6/1982 | Gurth |
| 4,490,049 | A | 12/1984 | Sanders et al. |

(Continued)

FOREIGN PATENT DOCUMENTS

KR 101237143 B1 * 2/2013

OTHER PUBLICATIONS

Espacenet Translation of Ji, Hyo Keun (KR 101237143 B1), published Feb. 25, 2013 (Year: 2013).*

(Continued)

*Primary Examiner* — Elizabeth Insler

(74) *Attorney, Agent, or Firm* — Vorys, Sater, Seymour and Pease LLP; William L. Krayer

(57) ABSTRACT

An improved cavitation mixing and heating device employs an inlet directed toward the vertex of a conical or similar flow-directing element. The flow patterns of the fluid material to be mixed and heated are designed to preheat, spread, and create turbulent flow mixing of the fluid before it enters the cavitation zone, using heat generated in the cavitation zone that is conducted through the body of the cavitation rotor. The functions of the axially oriented inlet and flow directing element are assisted by a cantilever construction to alleviate stress on the bearings.

6 Claims, 12 Drawing Sheets

(51) Int. Cl.
*B01F 7/10* (2006.01)
*B01F 7/26* (2006.01)

(56) References Cited

U.S. PATENT DOCUMENTS

| | | | | |
|---|---|---|---|---|
| 4,514,139 | A | 4/1985 | Gurth | |
| 4,773,819 | A | 9/1988 | Gurth | |
| 4,940,385 | A | 7/1990 | Gurth | |
| 5,419,306 | A | 5/1995 | Huffman | |
| 5,931,153 | A | 8/1999 | Giebeler | |
| 5,957,122 | A | 9/1999 | Grigs | |
| 6,164,274 | A | 12/2000 | Giebeler et al. | |
| 6,386,751 | B1 * | 5/2002 | Wootan | A01K 63/042 366/170.3 |
| 6,595,759 | B2 | 7/2003 | Crosta et al. | |
| 6,823,820 | B2 | 11/2004 | Thoma | |
| 6,910,448 | B2 | 6/2005 | Thoma | |
| 6,959,669 | B2 | 11/2005 | Thoma | |
| 6,974,305 | B2 * | 12/2005 | Garrett, III | F01D 1/34 415/206 |
| 7,097,416 | B2 | 8/2006 | Gurth | |
| 7,316,501 | B2 | 1/2008 | Thoma | |
| 7,553,124 | B1 | 6/2009 | Jiminez | |
| 2012/0014779 | A1 | 1/2012 | Gilliam | |
| 2015/0273415 | A1 * | 10/2015 | Ciaralla | B01F 3/0807 366/305 |

OTHER PUBLICATIONS http://www.mitcalc.com/doc/shafts/help/en/shafttxt.htm.

John Pacello and Peter Hanas, "Disc Pump-Type Pump Technology For Hard-To-Pump Applications" Presented at the "Proceedings of the 17th International Pump Users Symposium" (2000) at Texas A&M University.

* cited by examiner

CAVITATION DEVICE

CROSS REFERENCE TO RELATED APPLICATION

This application is a Continuation-in-Part of U.S. patent application Ser. No. 14/715,160 filed May 18, 2015 which claims the benefit of U.S. Provisional Application No. 62/200,116 filed on May 19, 2014, which are incorporated herein by reference in its entirety. This application also claims the benefit of U.S. Provisional Application No. 62/197,862 filed Jul. 28, 2015, which is also incorporated herein by reference in its entirety.

TECHNICAL FIELD

An axially-oriented inlet feeds fluid directly to the vertex of a generally conical, curved profile, or campanulate flow-directing face of a rotor containing cavities on its cylindrical surface. The flow director spreads the fluid to a cavitation zone formed between the cavity-containing surface and the closely conforming interior surface of a housing. The device pumps, heats and mixes the fluid. The device may contain discs to contribute an enhanced disc pump effect. The flow patterns of the fluid material to be mixed and heated are designed to preheat and may create turbulent flow mixing of the fluid before it enters the cavitation zone. Heat generated in the cavitation zone is conducted through the rotating disc-like body of the cavitation rotor. The advantages of the central inlet and flow directing element may be facilitated by a cantilever construction to alleviate stress on the bearings.

BACKGROUND OF THE INVENTION

The phenomenon of cavitation, as it sometimes happens in pumps, is generally undesirable, as it can cause choking of the pump and sometimes considerable damage not only to the pump but also auxiliary equipment.

However, cavitation, more narrowly defined, has been put to use as a source of energy that can be imparted to liquids. Certain devices employ cavities deliberately machined into a rotor turning within a cylindrical housing leaving space for liquid to pass. A motor or other source of turning power is required as well as an external pump to force the fluid through. The phenomenon of cavitation in all previous devices relevant hereto is caused by the rapid passage of the liquid over the cavities, which creates a vacuum in them, tending to vaporize the liquid; the vacuum is immediately filled again by the liquid and created again by the movement of the liquid, causing extreme turbulence in the cavities, further causing heat energy to be imparted into the liquid. Liquids can be simultaneously heated and mixed efficiently with such a device. Also, although the cavitation technique is locally violent, the process is low-impact compared to centrifugal pumps and mixing pumps employing impellers, and therefore is far less likely to cause damage to sensitive polymers used in oilfield fluids. Centrifugal pumps tend also to break large particles such as drill cuttings into small, low gravity particles which are more difficult to separate by centrifugation. The impeller blades of many types of pumps will fracture and break solids into smaller particles which may resist separation by any conventional method.

Good mixing is especially important in mixing oil field fluids such as drilling fluids and fracturing fluids.

Proper operation of the cavitation device, until now, has generally required a separate pump. Liquid must be forced through the existing cavitation devices to accomplish substantial heating, mixing, or both. Cavitation devices are excellent for intimately mixing gases with liquids, but centrifugal pumps do not handle large volumes of gases well, sometimes losing the ability to pump at all when the gas volume is too great. A disc pump can easily handle and pump mixtures containing significant volumes of gas.

Moreover, in the conventional cavitation devices, there is a viscous or surface effect drag against the stationary end wall of the cavitation device housing.

Rotating cavitation devices in the past generally have not been designed to optimize the flow of the incoming fluid, which must find its way from an inlet on one side of the rotor to and through the cavitation zone between the cylindrical interior of the housing wall and the cavities on the periphery of the rotor. Workers in cavitation mixing and heating in the past have generally not attempted to analyze and improve the flow patterns of the treated material on either the incoming or outgoing sides of the rotor, to achieve greater uniformity of heating and mixing. They have tended to concentrate on the phenomenon of cavitation at the periphery of the cavitation rotor, after the fluid arrives there, but have paid little attention to the heating potential of the body of the rotor or the effects on flow patterns of the sides of the rotor for enhancing mixing as well as heating.

Our invention provides improved heating, improved mixing, and improved uniformity of heating and mixing of fluid materials passing through a rotating cavitation device.

Unlike many designs of the prior art, our cavitation device is "overhung," meaning that it is supported on one side only of the housing. Because the other side of the housing is unencumbered by a support for the rotating power shaft, we are able to direct the incoming fluid to be mixed toward the center of the spinning rotor. The center of the spinning rotor, however, is modified in our invention so that the incoming fluid impacts on the vertex of a substantially conical or bell-shaped surface which provides a tapering, spreading, path for the fluid toward the side of the spinning rotor. The materials of construction of the rotor, and its shape, may also be chosen to transfer heat efficiently from the cavitation zone to the body of the rotor and then to the incoming fluid as it contacts the rotor. The overhung design is stabilized by at least one bearing on the rotating power shaft outside the housing in addition to the bearing in the housing wall. Beneficially, there are two additional bearings on the shaft, spaced from the housing wall before it connects to the motor.

In addition, the gap between the sides of the spinning rotor and the housing can be varied to optimize heating and mixing as a function of the assumed, presumed, or calculated properties of the treated fluid.

There is a need for improvements to overcome the disadvantages of the existing cavitation devices.

SUMMARY OF THE INVENTION

By the incorporation of at least one rotating disc having an open center for the passage of liquid, and with an appropriate housing design for intake and outflow, we are able to use the same motor that turns the cavitation device rotor to turn the disc also, thus utilizing the disc in combination with the cavitation rotor as a kind of disc pump to pass the liquid through the cavitation device. The rotating disc not only facilitates a pumping effect, but ameliorates the counterproductive drag imposed by the stationary housing wall of the unit.

In this continuation-in-part, the function and benefits of the central, or coaxial, inlet which facilitates the flow path through the open center of the disc have been further developed. This continuation-in-part utilizes a tapered flow director aligned with the rotating shaft and facing the central (coaxial) inlet to enhance the heating, mixing, and pumping effects of the device. The flow director is an improvement on the accelerator seen in FIG. 6. FIGS. 8-12 relate to the utilization of a flow director immediately next to the coaxial inlet guiding the fluid to distribution over the cavitation surface of the rotor; In FIG. 13, the flow director receives the incoming fluid through a rotating disc.

Our combined disc pump and cavitation device is inherently safer than the conventional use of a positive displacement pump to force the mixture through a separate cavitation device, in that, if there is a blockage of some sort, excess pressure will not build up within the device. Although the disc, or discs, will continue turning, they will generate only a relatively low pressure within the device.

The shaft may pass through both end walls or only one end wall. The inlet and outlet may be independently on the respective end wall or on the cylindrical shell, providing a flow path for the fluid across the cavitation device—that is, forming an inlet end and an outlet end of the device for the flow path.

The combined device may be immersed in a mixing tank so that its intake is below the level of the materials to be mixed; the motor may be above the liquid level or its shaft may pass through the wall of the tank.

DETAILED DESCRIPTION OF THE INVENTION

Figure 1:
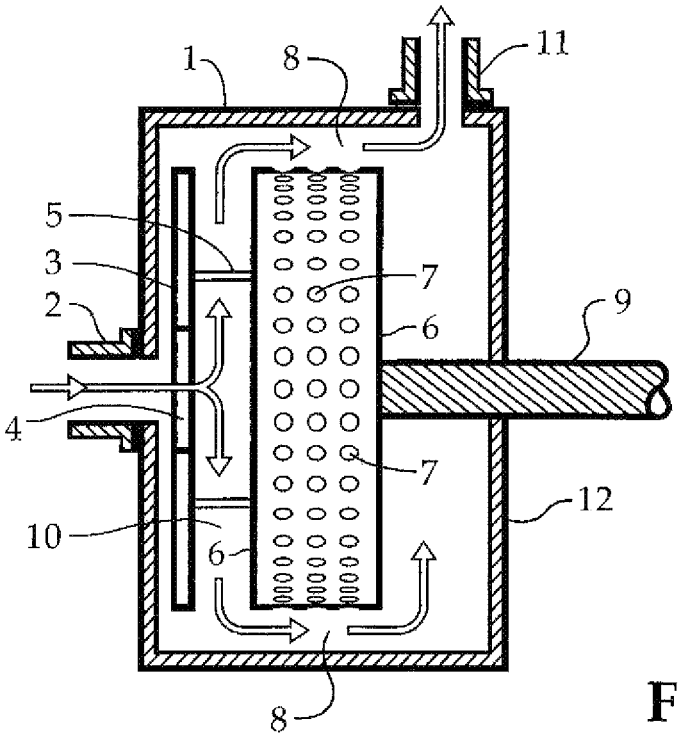
FIG. 1 is a side sectional view of the cavitation pump.

Referring first to FIG. 1, the cavitation pump is shown in section and more or less diagrammatically. Fluid enters a housing 1 through a conduit 2 passing through central hole 4 in solid disc 3. Solid disc 3 is held in place by disc supports 5, which are attached to cavitation rotor 6. Cavitation rotor 6 is substantially cylindrical in shape and has a plurality of cavities 7 on its cylindrical surface. Housing 1 is also substantially cylindrical in shape so that its inside surface can accommodate the cylindrical surface of the cavitation rotor 6 substantially concentrically and in close proximity. That is, the peripheral space 8 between the cavitation rotor 6 and the substantially concentric internal surface of the housing 1 is somewhat constricted to enhance the efficiency of the cavitation effects on the fluid, as will be explained more fully below. Cavitation rotor 6 is mounted on a shaft 9 which passes through the end wall 12 of housing 1 by way of a thrust bearing having a seal, not illustrated. The end wall 12 of housing 1 is substantial enough to accommodate the thrust bearing, which permits rotation of the shaft 9 and its attached cavitation rotor 6 and solid disc 3, and a suitable seal to prevent leakage. Suitable fixtures for the conduit 2 may also be envisioned. As indicated by the arrows, fluid flows into the housing 1 through conduit 2, then through the central hole 4 of solid disc 3; it then fans out 360 degrees in the distribution space 10 between solid disc 3 and cavitation rotor 6, finally exiting peripherally through fluid outlet 11. By peripherally, I mean on the rounded, or cylindrical, surface of housing 1 as opposed to the normally substantially planar end wall 12. It may also be noted that the cylindrical housing has an inlet end near solid disc 3 and an outlet end on the opposite side of rotor 6. In a variation, the outlet may be located on end wall 12.

The cavitation rotor 6, acting within a surface-conforming housing 1, acts in a known manner to simultaneously heat and intimately mix fluids. But unlike previously known devices, fluid entering through conduit 2 of the present invention need not be pumped or otherwise under positive pressure. Introduction of solid disc 3 provides a disc pump action integral to the cavitation device. Various aqueous and nonaqueous liquids may be mixed in our invention; solid materials may be dissolved or hydrated, and gases, including air, may be introduced to the mix, most conveniently by injecting them into conduit 2.

Cavitation devices are designed deliberately to generate heat by cavitation. Cavitation occurs in a fluid when the fluid flows in an environment conducive to the formation of partial-vacuum spaces or bubbles within the fluid. Since the spaces or bubbles are partial vacuum, they almost immediately implode, causing the mechanical or kinetic energy of the fluid to be converted into thermal energy. In many devices, such as most pumps, cavitation is an occurrence to be avoided for many reasons, not only because of convulsions and disruption to the normal flow in the pump, but also because of the loss of energy when the mechanical energy of the pump is converted to undesired heat instead of being used to propel the fluid on a desired path. There are, however, certain devices designed deliberately to achieve cavitation in order to increase the temperature of the fluid treated. Such cavitation devices are manufactured and sold by Hydro Dynamics, Inc., of Rome, Ga., perhaps most relevantly the devices described in U.S. Pat. Nos. 5,385,298, 5,957,122, 6,627,784 and particularly U.S. Pat. No. 5,188,090, all of which are hereby specifically incorporated herein by reference in their entireties. These patents may be referred to below as the HDI patents.

The basic design of the cavitation devices described in the HDI patents comprises a cylindrical rotor having a plurality of cavities bored or otherwise placed on its cylindrical surface. The rotor turns within a closely proximate cylindrical housing, permitting a specified, relatively small, space or gap between the rotor and the housing. Fluid enters at the face or end of the rotor, flows toward the outer surface, and enters the space between the concentric cylindrical surfaces of the rotor and the housing. While the rotor is turning, the fluid continues to flow within its confined space toward the exit at the other side of the rotor, but it encounters the cavities as it goes. Flowing fluid tends to fill the cavities, but is immediately expelled from them by the centrifugal force of the spinning rotor. This creates a small volume of very low pressure within the cavities, again drawing the fluid into them, to implode or cavitate. This controlled, semi-violent action of micro cavitation brings about a desired conversion of kinetic and mechanical energy to thermal energy, elevating the temperature of the fluid without the use of a conventional heat transfer surface.

Benefits of the HDI-style cavitation devices include that they can handle slurries as well as many different types of mixtures and solutions, and the heating of the fluid occurs within the fluid itself rather than on a heat exchange surface which might be vulnerable to scale formation and ultimately to a significant loss of energy and reduction in heat transfer.

However, the conventional cavitation devices require the use of an external pump. Our invention incorporates a disc pump into the housing used by the cavitation rotor, and utilizes one side of the cavitation rotor as part of the disc pump. None of the versatility of the conventional cavitation devices in handling solutions, mixtures and slurries is sacrificed by combining the disc pump action with cavitation in the same housing.

Figure 2:
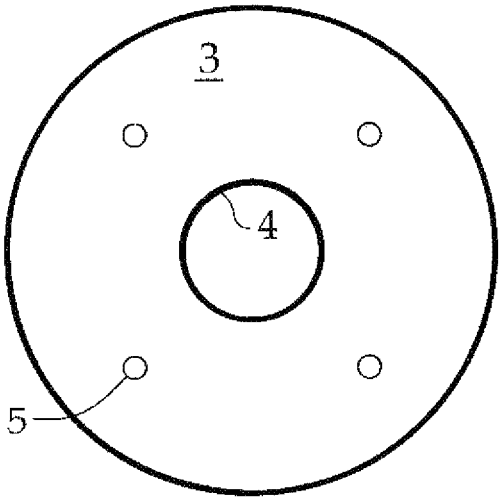
FIG. 2 is a front view of a pump disc.

Referring now to FIG. 2, the solid disc 3 is seen from the front. It has a hole 4 in its center to permit fluid to pass through, and has a plurality of disc supports 5 (see FIG. 1 also) to retain it in place in a plane substantially parallel to that of the cavitation rotor 6; thus it rotates with the cavitation rotor 6.

Figure 3:
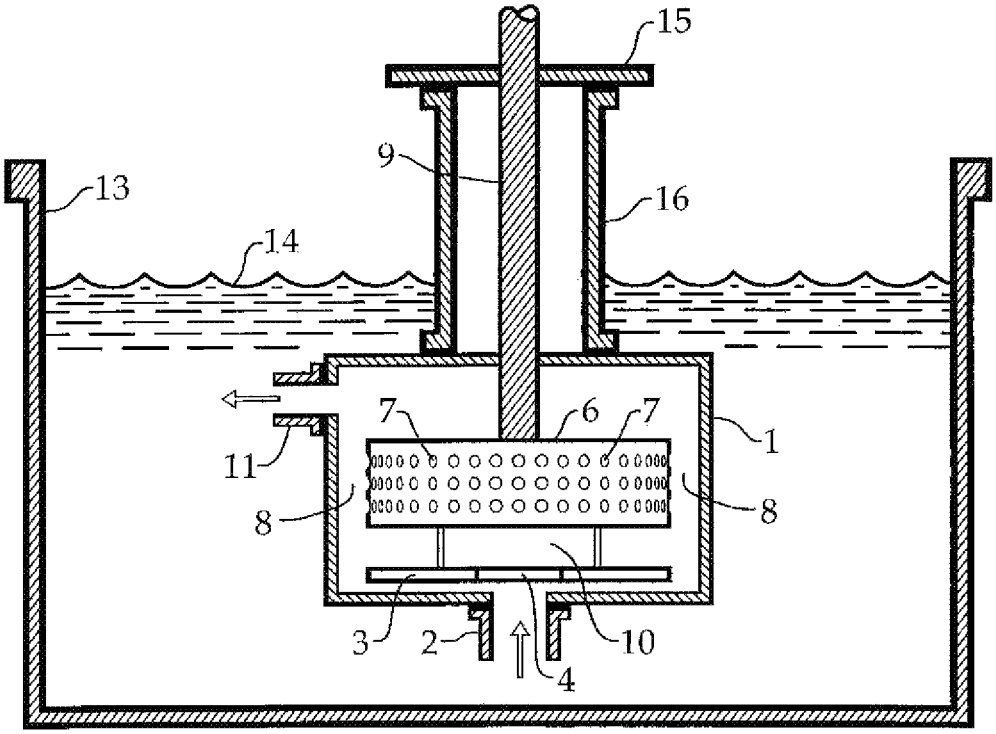
FIG. 3 is side sectional view of the cavitation pump employed as a tank mixer.

In FIG. 3, the cavitation pump of FIG. 1 is set up to mix materials in tank 13. Housing 1 is fully submerged in tank 13, in fluid having a fluid level 14. A motor not shown is mounted on motor base 15 and stabilized by housing supports 16. Motor shaft 9 passes below fluid level 14 and through housing 1 as explained in FIG. 1, and rotates cavitation rotor 6, which has cavities 7. Fluid already in the tank enters through conduit 2 through central hole 4 of disc 3 and passes into distribution space 10, through peripheral space 8, and out fluid outlet 11 as described with respect to FIG. 1. Fluid outlet 11 may have an extension or otherwise connect to the open space above fluid level 14 to reduce back pressure. As indicated in the discussion above, the cavitation rotor 6 acting on the liquid within the confined peripheral space 8 will heat the fluid, which will facilitate and render more efficient the mixing of whatever materials are in the fluid. Various aqueous and nonaqueous fluids may be mixed, and many different types of solids may be readily dissolved or dispersed with the cavitation pump, which does not require any pumping or positive force to cause the fluid to enter. Materials to be mixed are added to the tank in any convenient manner.

Figure 4:
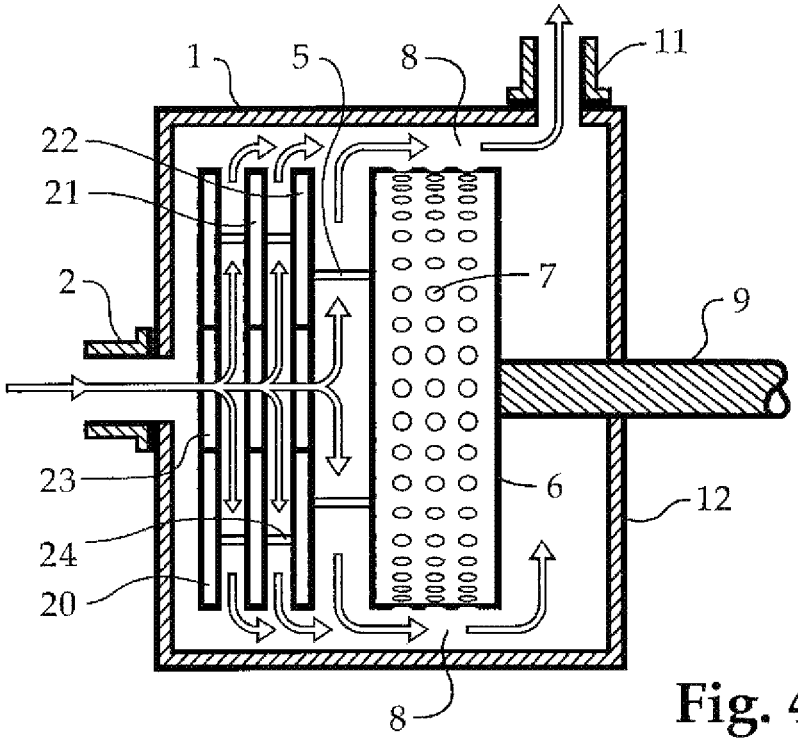
FIG. 4 shows a variation of the invention having more than one disc.

FIG. 4 is a sectional view similar to FIG. 1 except that it incorporates three discs 20, 21, and 22. Discs 20, 21, and 22 may be thinner or thicker than disc 3 of FIG. 1, but each has a central hole similar to central hole 4 of disc 3—central hole 23, for example, is in disc 20. The cavitation pump of FIG. 4 has a cavitation rotor 6 for rotating with shaft 9 in cylindrical housing 1 as in FIG. 1. Disc supports 5 connect cavitation rotor 6 to disc 22, disc supports 24 connect disc 22 to disc 21, and disc 21 to disc 20, maintaining all the discs in planes substantially parallel to cavitation rotor 6. Cavitation rotor 6 has cavities 7 also as in FIG. 1.

Fluid enters through conduit 2 as in FIG. 1, and passes through central hole 23 of disc 20. As shown by the arrows, some of the fluid is distributed between discs 20 and 21; some continues through the central hole of disc 21 (similar to central hole 23 of disc 20), where some is distributed between disc 21 and disc 22; some fluid continues through the hole in disc 22 and is distributed between disc 22 and cavitation rotor 6. A motor not shown turns shaft 9, turning the rotor 6 and all three discs, causing the centrifugal distribution of the fluid as indicated by the arrows, acting as a pump to continue the flow of fluid. In the peripheral space 8, the fluid continuously flows into cavities 7 and is flung out by centrifugal force, thereby creating the alternating vacuum and micro-implosions that effectively mix and heat the fluid before it exits at fluid outlet 11.

A multidisc variant of our invention such as is illustrated in FIG. 4 can be used in the tank mixing configuration of FIG. 3.

Our cavitation pump can employ several discs aligned in a manner similar to that shown in FIG. 4; as a practical matter, the strength of the seal and bearing for the shaft 9 in end wall 12 may be a limiting factor; otherwise there is no reason not to have as many as twelve or more discs.

Figure 5:
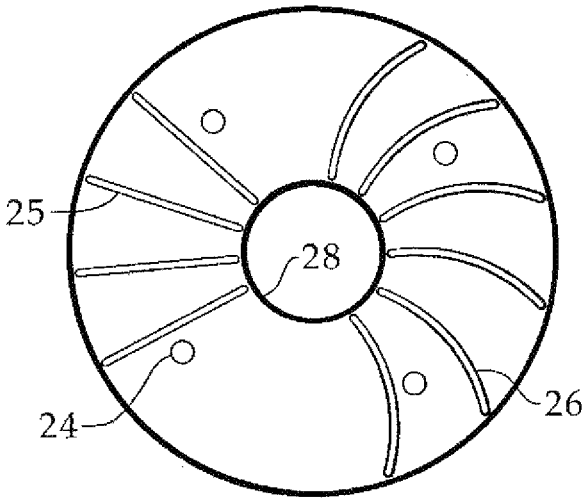
FIG. 5 illustrates a disc having splines.

FIG. 5 shows the face of a disc similar to discs 20, 21, and 22 in FIG. 4 except that it has splines, illustrated as straight radial splines 25 and curved splines 26. As with the other illustrated discs, the disc of FIG. 5 has a central hole 28 and disc supports 24 which may be similar to disc supports 5. Splines are ridge-like protuberances designed to encourage the flow of the fluid from the center of the disc to its periphery; hence they are generally radial. Splines 25 are substantially straight and splines 26 have a curve which may be designed to take into account the speed of rotation of the disc. Although the illustration of FIG. 5 shows both kinds on the same disc, the user may wish to have one or the other, or no splines at all. The splines need not extend the entire distance from the edge of hole 28 to the rim of the disc, as illustrated. Splines may be included on one or both sides of the discs, and may be built into one or both sides of rotor 6.

Figure 6:
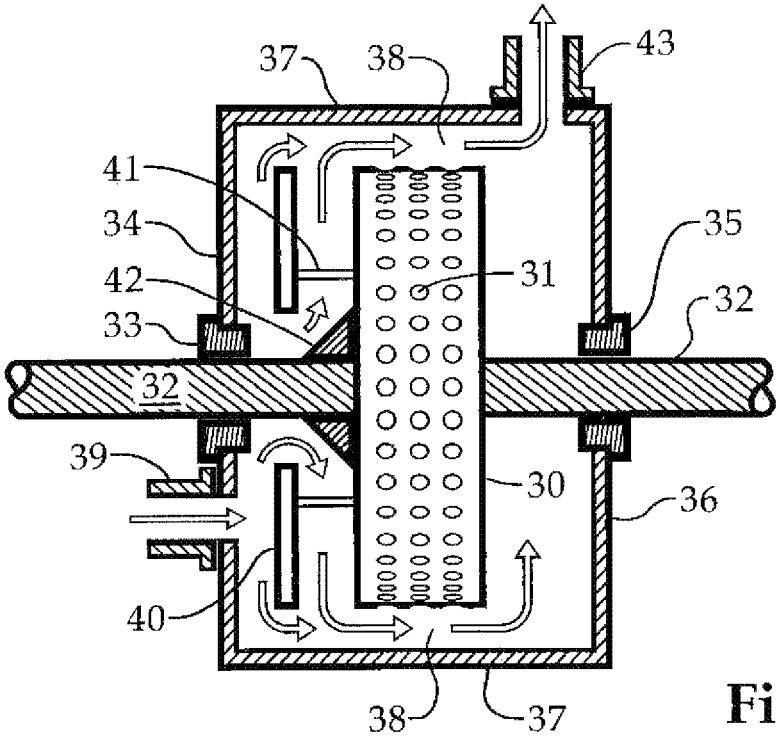
FIG. 6 shows a variation in which the shaft passes through both ends of the cylindrical housing.

Referring now to FIG. 6, cylindrical rotor 30 having cavities 31 is mounted on shaft 32 substantially as previously described. Shaft 32 is connected to a motor or other power source not shown. Shaft 32 passes through seal 33 in end wall 34 of the housing as well as seal 35 of end wall 36 of the housing. Cylindrical shell 37 is substantially concentric to the periphery of rotor 30, forming a cavitation zone 38, similar to peripheral space 8 in FIG. 1, around rotor 30. Fluid entering inlet 39 encounters disc 40, which is held in place by supports 41 connected to rotor 30. Disc 40 has a central hole 44 (see FIG. 7) similar to central hole 4 in FIG. 1. Unlike FIG. 1, fluid entering through inlet 39 does not pass directly into the hole 44 but impacts disc 40 as may be seen also in FIG. 7. Helping to direct the flow as indicated by the arrows is an optional accelerator 42, having a slanted or conical surface around shaft 32. The surface of accelerator 32 may have a curved profile as well as the straight profile shown. After passing through the cavitation zone 38 as indicated by the arrows, the fluid, now well mixed, exits through outlet 43. Outlet 43 need not be on cylindrical shell 37 as shown, but could alternatively be located in end wall 36. The outlet is positioned so that the fluid must traverse the full width of rotor 30 before reaching it. As seen in FIG. 6, inlet 39 and outlet 43 define a flow path half way around the internal surface of shell 37 as well as through cavitation zone 38. The invention is not limited to the placement of the inlet and outlet 180 degrees apart with respect to shell 37. They may be placed at any angular distance from each other with respect to the cylindrical shell 37.

The FIG. 6 variation of the invention is not limited to the use of only one disc. It may have two, three (as seen in FIG. 4) or more. Since shaft 32 passes through both end walls 34 and 36, the variation of FIG. 6 is quite rugged. But it should be noted also that a significant advantage of all variations of our invention is that it can handle high viscosity fluids more efficiently than a centrifugal pump.

Figure 7:
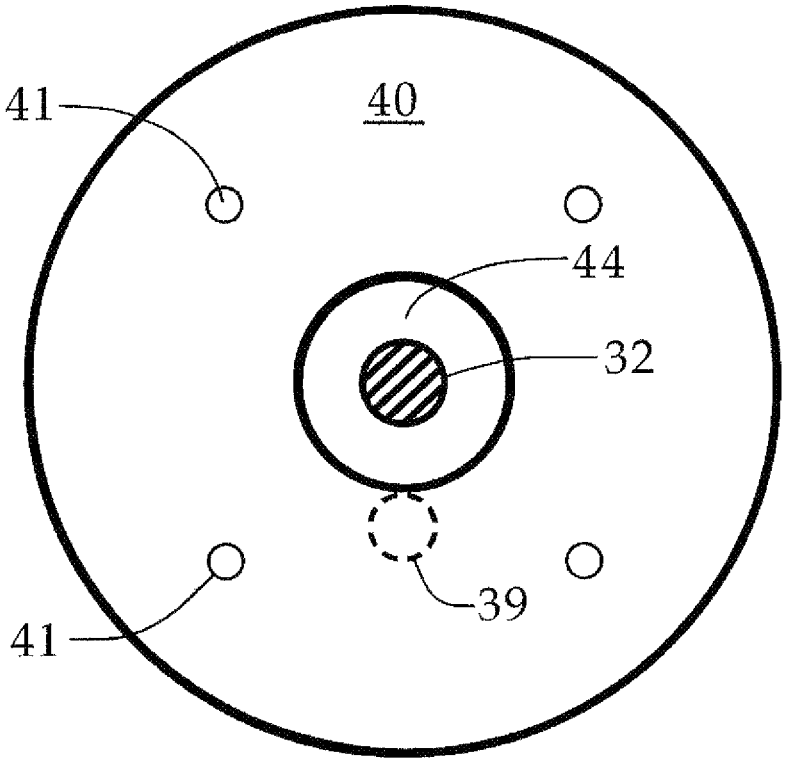
FIG. 7 is the face of the disc in FIG. 6.

FIG. 7 shows the face of disc 40, to illustrate that it encircles shaft 32 while inlet 39 is not centrally located as inlet 2 is in FIG. 1. Fluid entering inlet 39 will tend to impact disc 40 and will flow both toward the cylindrical shell 38 (see FIG. 6) and through hole 44, in both cases having to pass through cavitation zone 38 before arriving at outlet 43. Disc 40 may have splines as described with respect to FIG. 5.

The variation of FIGS. 6 and 7 can be immersed in a tank in a manner similar to that shown in FIG. 3.

Since our device does not require an external high pressure pump, high pressure seals are not needed. They may be desired, however, to protect against the possibility of a high pressure backup event or some other unforeseen circumstance.

The invention includes a technique for starting up wherein the device is partially filled with fluid before the rotation is begun—that is, before the motor is started. The reduced torque requirements of a partially filled device will enable a smooth startup.

Our cavitation pump can be used to prepare drilling muds, completion fluids, and fracturing fluids for use in hydrocarbon recovery, and to hydrate synthetic and natural polymers for use in oilfield fluids. Excellent mixing can be accomplished without a tank as shown in FIG. 3—that is, various materials including at least one fluid can be present in inlet conduit 2 as shown in FIG. 1, and they will be thoroughly mixed by activating the motor to turn shaft 9.

FIGS. 8-13 are added for this continuation-in-part.

Figure 8:
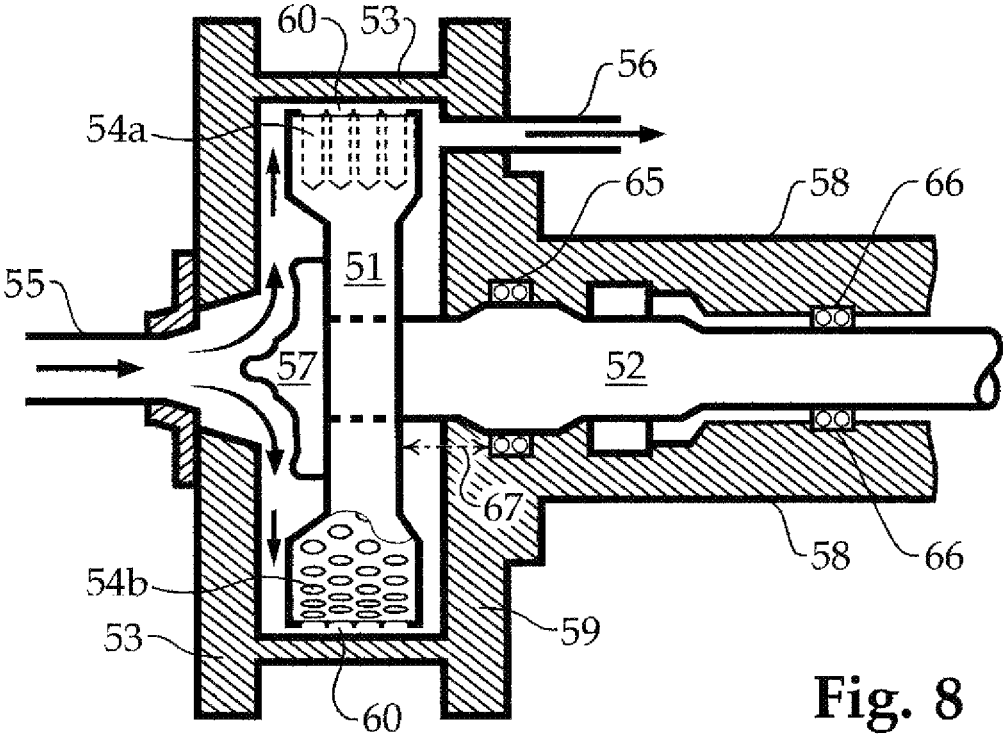
FIG. 8 is a partly sectional view of our cavitation device having a flow director oriented toward the inlet.

In FIG. 8, cavitation rotor 51 is mounted on a shaft 52 which is turned by a motor, not shown, on shaft 52. Shaft 52 is supported by sleeve 58. Shaft 52 passes through a bearing 65 in wall 59 of housing 53. Cavitation rotor 51 is substantially cylindrical, and is situated within housing 53 having a substantially cylindrical interior. The cylindrical surface of cavitation rotor 51 contains a plurality of cavities; the cavities are illustrated as cavities 54*a*, showing their depth, and cavities 54*b*, showing their openings; the cavities may be referred to below as cavities 54. The cavities 54 (54*a* and 54*b*) generally cover the entire cylindrical surface of cavitation rotor 51, whose cylindrical surface is substantially concentric to the interior surface of housing 53, leaving a substantially uniform gap between the two cylindrical surfaces; this gap is referred to as the cavitation zone 60 because the flowing fluid, confined in the gap, is subjected to a powerful cavitation effect to be explained further below. The cylindrical surface 51 containing cavities may be referred to herein as the "cavitation surface."

It should be noted that the surface 51 need not be strictly cylindrical. For example, it may be frusto-conical or partly frusto-conical, with a conforming surface inside housing 53, but we prefer cylindrical for the cavity-containing surface because, with a conical surface, or any other surface having cavities located on a relatively short radius from the shaft, cavities on the short radius will not be as efficient as those on the full radius of the rotor 51, primarily because their peripheral velocity will not be as high and the centrifugal forces will not be as great as those on the full radius. The term "cavitation surface" as used herein nevertheless is intended to include any surface on a rotor which contains cavities intended to induce cavitation.

Housing 53 includes an inlet 55 for incoming material to be mixed, heated, or otherwise treated, and an outlet 56 for the product. Outlet 56 need not be exactly where shown in FIG. 8; it could be closer to shaft 52 or could be located on the upper (cylindrical) surface of housing 53. Inlet 55 is located centrally with respect to the axes of rotor 51 and shaft 52 so that fluid material entering inlet 55 immediately encounters flow director 57, which is attached to or integral with the center of cavitation rotor 51 and therefore spinning with rotor 51.

The flow path of the materials to be mixed (or otherwise treated) is indicated by the arrows, beginning at inlet 55, continuing (in this view) upwardly and downwardly as the spinning rotor 51 urges the material to the peripheries of flow director 57 and cavitation rotor 51. The fluid then proceeds into cavitation zone 60 across the cylindrical surface of cavitation rotor 51. As is known in the art, a fluid flowing in such a gap (between a spinning rotor having cavities and a closely set conforming surface) constantly falls into cavities 54, but is almost immediately thrown out by centrifugal force, causing a mini-vacuum in the cavities 54, which in turn tends to draw the fluid back into the cavities 54. This mini-violent turbulence causes excellent mixing while also generating heat without chance of scale buildup. As is also known in the art, cavitation efficiency is affected by the velocity of the rotor's periphery as well as the gap height. Cavitation zone 60, the gap between the periphery of cavitation rotor 51 and the cylindrical internal surface of housing 53, may be from 0.1 inch to 1.0 inch in height, or as much as 3 inches, in order to achieve an efficient cavitation effect within a wide range of peripheral velocities and fluid properties. The system can handle a great variety of liquids and gases with or without solid particles. Normally a pump, not shown, upstream from inlet 55, will assure passage of the fluid into the housing 53.

From the cavitation zone 60, the fluid passes to outlet 56. Where the cavitation device is making drilling fluid for use in well drilling, it may be sent directly to the well; for many other purposes it may be sent to storage.

We may make our cavitation rotor of steel or stainless steel but alternatively we may use titanium because of its light weight and resistance to corrosion. Any material of suitable strength may be used. Various abrasion-resistant and corrosion-resistant coatings may be used on rotor 51 and flow director 57 as well as the interior of housing 53. Titanium weighs about 55% less than steel. Lighter weight means the rotor can be larger than it otherwise might be. A larger diameter rotor means a higher peripheral velocity for a given angular velocity, and the peripheral velocity is an important function in the cavitation effect. A larger rotor also means the ability to include more cavities on the rotor's cylindrical surface, whether the increased size is realized in a wider cavitation zone or a larger diameter. And not least important, a lighter rotor means less stress on the shaft bearing 65 in housing wall 59. However, a lighter rotor reduces the flywheel effect compared to a heavier one of the same shape and size. All such factors may be considered and varied with the fluid processed and the results desired.

The cavitation rotor 51 is seen to be wider at its periphery than in its central body. This is done to reduce the overall mass of the rotor and to enhance the transfer of heat from the body surface to material in contact with it and flow director 57. The cavitation process constantly generates heat energy which is not only instilled in the fluid by intimate cavitation, but also conducted through the metal body of the rotor 51 to its side surfaces, including flow director 57, where it is picked up by the fluid being treated. As a rule of thumb, we may reduce the mass of the rotor 51 by "hollowing out" perhaps twenty percent or more of the volume of a purely cylindrical shape of the same outer dimensions. Reducing the mass means the rotor is less of a heat sink and more of a heat transfer element. The somewhat dumbbell shaped profile also means that the mass actually present is distributed to provide a noticeable flywheel effect, thus reducing the energy needed to maintain rotation in the viscous materials we treat.

We further reduce stress on the bearing 65 in housing wall 59 through the use of a cantilever bearing 66 on sleeve 58 and shaft 52, spaced from bearing 65 to counterbalance the downward force of rotor 51. That is, to the extent bearing 65 in housing wall 59 acts somewhat like a pivot, its stress is relieved by the leverage of the spaced-apart bearing 66 on shaft 52. It may be noted, however, that the possible reduction in weight realized by the use of titanium in rotor 51 would also reduce stress on bearing 65, as does the buoyant effect of rotor 51's total immersion in fluid, which is commonly quite dense in practice. But density and viscosity of drilling fluid, for example, places great stress on the entire device including the bearings. As a rule of thumb, the cantilever effect may be accomplished by placing bearing 66 at least twice as far away from bearing 65 as bearing 65 is from the cavitation rotor 51. That is, referring to FIG. 8, the distance between bearings 65 and 66 is seen to be more than twice the distance between rotor 51 and bearing 65 as indicated by dotted arrow 67. However, persons skilled in the art may wish to refer to the literature on stabilizing shafts which considers the shaft shape and diameter, loading forces, rotating masses, stress under various conditions, and other factors. See, for example, the MIT on-line publication www.mitcalc.com/doc/shafts/help/enshaftxt.htm.

Flow director 57, sometimes called an accelerator, can have various profiles, such as parabolic, elliptical, spiral, hyperbolic or generally campanulate. All of these have a vertex and a base, generally a wide circular base. The flow director's shape and position with respect to the inlet should assure that the incoming fluid strikes its highest point (the vertex) first and, because the flow director 57 is spinning along with the cavitation rotor 51, is spread towards its lower regions (that is, the flared or asymptotic base edge of the conical or tapering shape) and onto the surface of the body of the rotor 51 before it reaches the cavitation gap 60. Flow director 57 can contain ridges, channels, bumps, and various other turbulence-inducing protuberances, or spiral threads, but overall should exhibit a generally conical, tapering, or bell-shaped profile.

Figure 9:
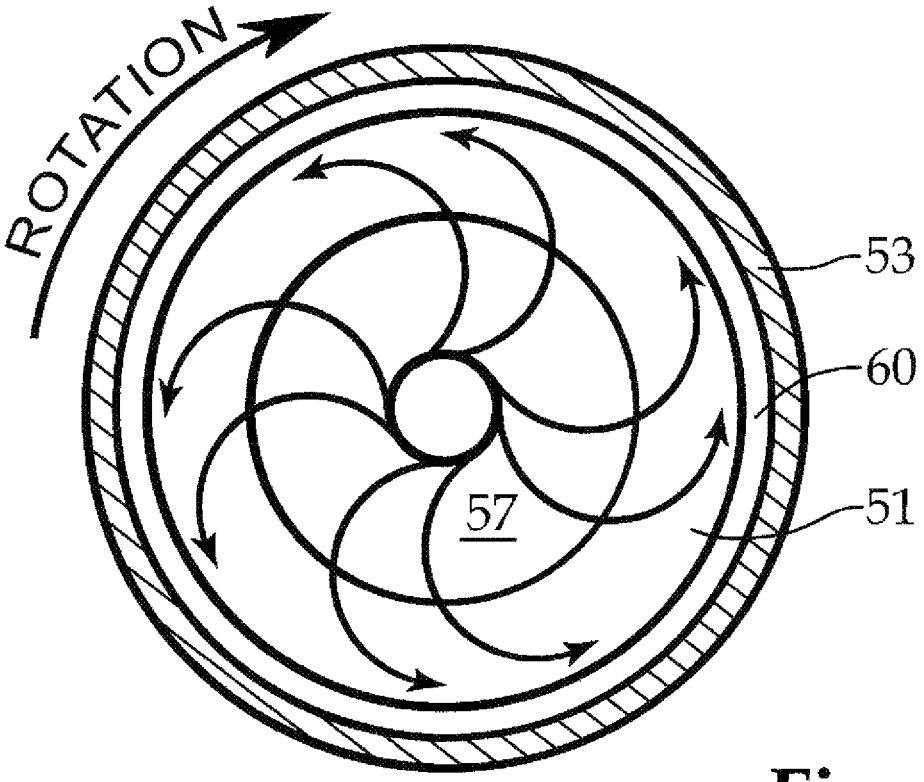
FIG. 9 is a frontal view of the cavitation rotor with a flow director, showing the resulting flow pattern of incoming fluid.

FIG. 9 shows the flow pattern on and near the flow director 57 and cavitation rotor 51, from the perspective of the inlet 55 (Inlet 55 is visible in FIG. 8). Arrows indicating the direction of flow of the fluid on the flow director 57 appear to be headed in a direction opposite the direction of rotation of the cavitation rotor 51 and the flow director 57. This is because the rotation speed of the rotor is normally greater than the flow rate; moreover, as is known from the technology of spinning disc reactors, the fluid tends to spread towards the periphery of the spinning disc and tends to become a thinner layer of material as it is centrifugally forced to the periphery. In the construction of FIG. 8, unlike on a spinning disc reactor, a thin film is not formed, as the entire volume within housing 53 is filled with moving fluid. But the spreading effect caused by the spinning flow director is quite uniform in both the dispersion of the fluid to the periphery of the rotor 51 and in the establishment of a distinct turbulent regime above the flow director 57, as will be illustrated in FIG. 10. On reaching the periphery of the cavitation rotor 51, the fluid to be mixed enters cavitation zone 60 between cavitation rotor 51 and housing 53 for processing as described with respect to FIG. 8.

Figure 10:
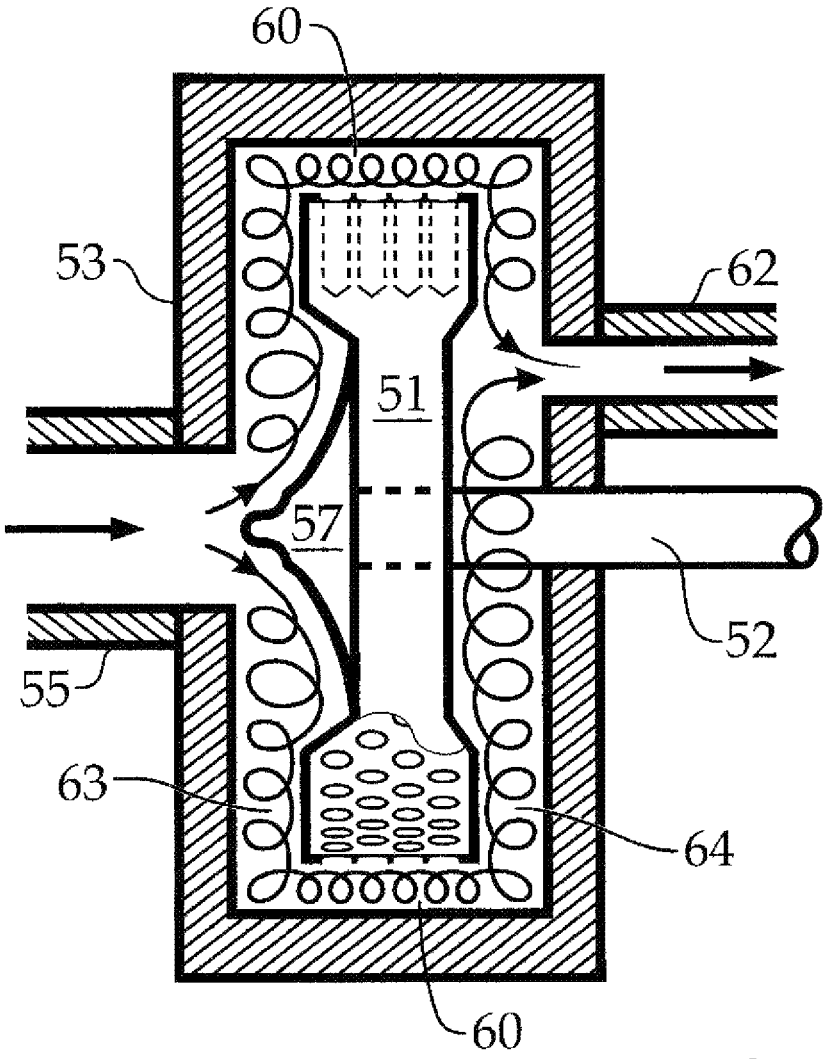
FIG. 10 is an expanded section of the cavitation device showing flow patterns in more detail; the outlet is placed near the shaft.

From FIG. 10, and recalling the spreading and thinning effects near the surface of flow director 57 depicted in FIG. 9, it is seen that a much more turbulent flow is achieved in the larger space between housing 53 and rotor 51 as the fluid moves toward the cavitation zone 60. The turbulence is depicted in the form of long coiled arrows. This turbulence on the sides of the rotor 51, which is a function of the gap between the housing 53 and rotor 51, combined with the spreading and thinning "spinning disc" effects seen in FIG. 9, results in a very efficient and uniform heat transfer from the rotor 51 to the fluid. Heat, constantly generated in the cavitation zone 60, is conducted through the metal of rotor 51 and is picked up by the fluid at all points on the rotor surface by ever-changing portions of the fluid. The fluid is thus substantially uniformly preheated when it enters the cavitation zone 60, where it tends to assume a Taylor-Couette flow [see Taylor, G. I (1923) "Stability of a Viscous Liquid contained between Two Rotating Cylinders" *Phil. Trans. Royal Society* A223 (605-615); Gollub, J. P.; Swinney, H. L. (1975) "Onset of Turbulenbce in a rotating fluid" *Physical Review Letters* 35 (14): 927-930]. Taylor-Couette flow occurs between a rotating surface and one which is not rotating, or between other parallel or concentric surfaces, both of which are rotating at different rates or in different directions. Significant factors for turbulence in a Taylor-Couette setting are the viscosity of the fluid and the gap between the two surfaces. We have found, as indicated elsewhere herein, that the cavitation zone 60 gap should be between 0.1 inch and 1.0 inch and may be as much as 3 inches or more. Although the cavitation process is highly significant in our device, it does not neutralize the manifestation of Taylor-Couette principles.

It should be noted in FIG. 10 that, while inlet 55 sends incoming fluid toward the center of flow director 57 as in FIG. 8, the outlet 62 in FIG. 10 is much closer to shaft 52 than outlet 56 of FIG. 8. Placing the outlet closer to shaft 52 than the internal cylindrical surface of the housing 53 permits considerably more mixing on the outlet side of rotor 51, reduces the likelihood of relatively quiescent areas within housing 53, and permits more contact by the fluid with the heated body of rotor 51 before it exits. Note also that flow director 57 has a more tapering, flattened bell shape than flow director 57 of FIG. 1. As discussed elsewhere herein, the flow director may assume various shapes; in the case of FIG. 10, flow director 57 flares around its perimeter, permitting an even, smooth distribution over the side of rotor 51 somewhat more consistent with "spinning disc" principles. [see Brian Launder, Sebastien Poncet, Eric Serre: Laminar, Transitional, and Turbulent Flows in Rotor-Stator Cavities. Annual Review of Fluid Mechanics, Annual Reviews, 2010, 42 (1), pp. 229-248. <10.1146/annurev-fluid-121108-145514>. <hal-00678846>]

Our device is useful for many different processes including mixing and heating, but it is especially useful for viscous materials, such as drilling muds and polymer solutions. It can heat and mix a wide variety of combinations of liquids, solids and gases having a wide range of composition, viscosities and other physical properties. Drilling muds and oil field polymer solutions have been very difficult to handle in the past, but we have found that our invention is very useful for them. By adjusting the gap 63 between housing 53 and the left (incoming) side of rotor 51 in reference to the expected physical characteristics of the fluid, particularly the viscosity, we can optimize both the "spinning disc" effects and the turbulence indicated by the arrows in FIG. 10.

The gap 63 between cavitation rotor 51 and housing 53 may be varied by shifting the entire assembly of shaft 52, rotor 51, and flow director 57 to the right or left, as depicted, and securing it in its new position. If shifting the assembly of shaft 52, rotor 51 and flow director 57 closer to inlet 55 is deemed to widen gap 64 on the outlet side of housing 53 too much, one or more spacer discs may be placed directly on the outlet side of rotor 51 to compensate. Alternatively, gap 63 may be changed by adjusting the location of rotor 51 on shaft 52 in either direction, or by replacing flow director 57 with a flow director of a different thickness.

Figure 11:
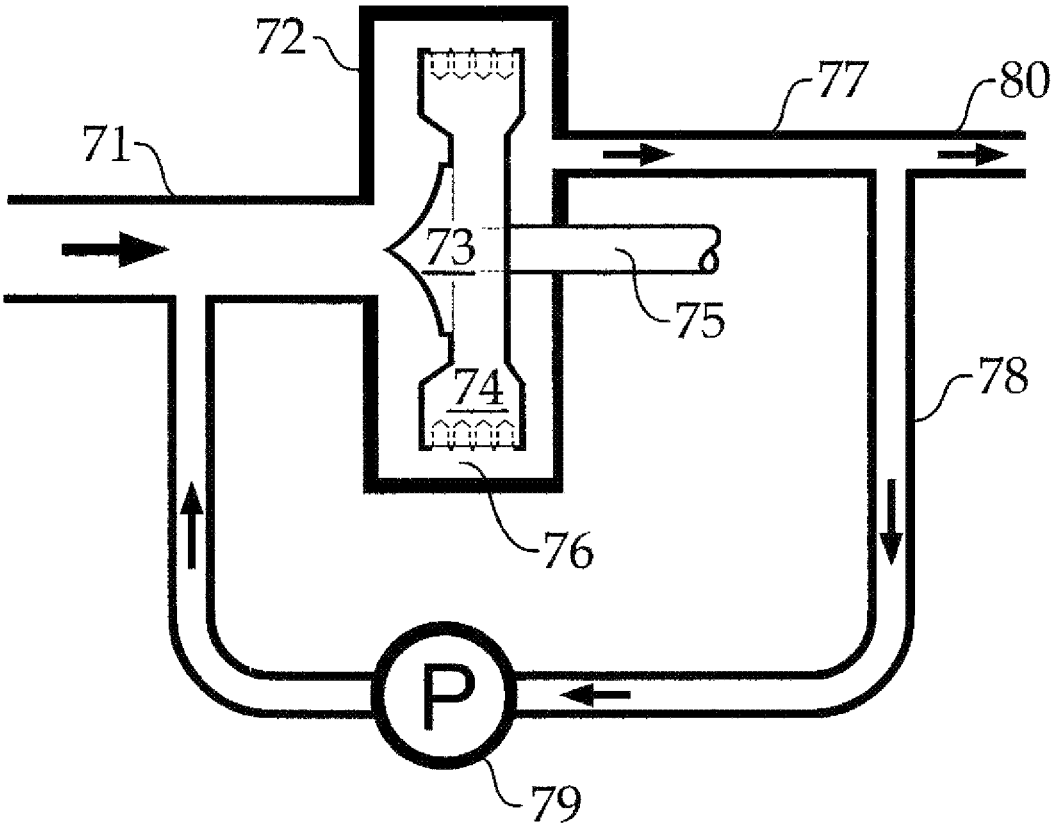
FIG. 11 shows the cavitation device with recirculation piping to elevate the temperature of the fluid and improve mixing.

Referring now to FIG. 11, a recirculation loop is shown in outline form. A fluid to be mixed and heated is sent through inlet 71 to the interior of housing 72 where it encounters flow director 73 on cavitation rotor 74, being spun by shaft 75 connected to a motor not shown. The fluid is distributed by flow director 73 as explained in FIGS. 8, 9, and 10, subjected to turbulence-inducing motion of rotor 74 acting within the walls of housing 72, passed through the cavitation zone 76 where it is subjected both to Taylor-Couette effects and cavitation, and then passed to housing outlet 77. Using appropriate valves not shown, a portion of the mixture from housing outlet 77 is diverted through conduit 78 to pump 79 and directed back to inlet 71, where it mingles with the incoming fluid and is sent through the unit again. A recirculation mode could, for example, feed ¼ barrel per minute (bpm) to inlet 71, remove ¼ bpm from exit 80, and divert one bpm from outlet 77 for immediate recirculation. It should be noted that results more or less equivalent to recycling a portion of the fluid can be obtained simply by reducing the rate of flow of fluid through the device.

Figure 12:
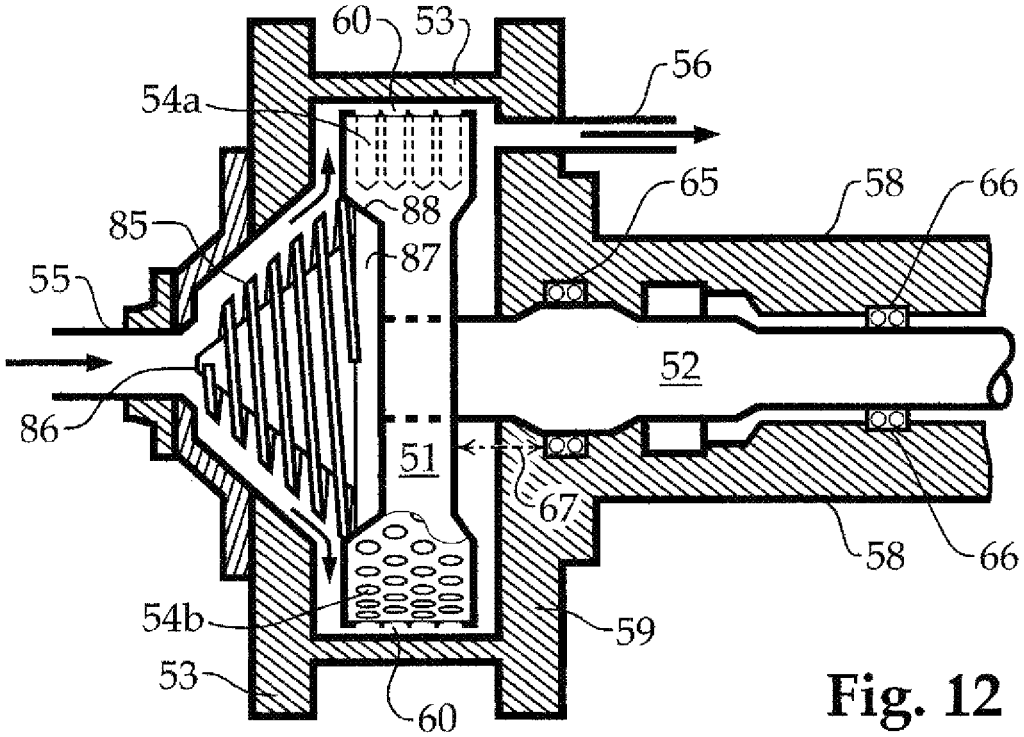
FIG. 12 illustrates a screw-shaped flow director in our cavitation device.

FIG. 12 is similar to FIG. 8, but illustrates a screw-shaped flow director 85. As with the other variations of the flow director of our invention, flow director 85 has a vertex 86 oriented directly into the flow of fluid entering the device through inlet 55, normally assured by a pump (not shown) sending fluid to inlet 55. Flow director 85 may be longer and more tapering, or its generally circular base 87 may be smaller, not necessarily covering the entire shoulder 88 of rotor 51. A screw-shaped flow director such as flow director 85 will very efficiently spread the incoming fluid to its generally circular base 87 and then to the periphery of rotor 51 for entry into cavitation zone 60 around the entire periphery of rotor 51. We believe that, as with the other shapes of flow directors illustrated and described herein, although the fluid is spread more or less evenly over the flow director 85, there is also a degree of turbulence generated which enhances the ability of the device to preheat the incoming fluid to an extent before it enters the cavitation zone 60.

Figure 13:
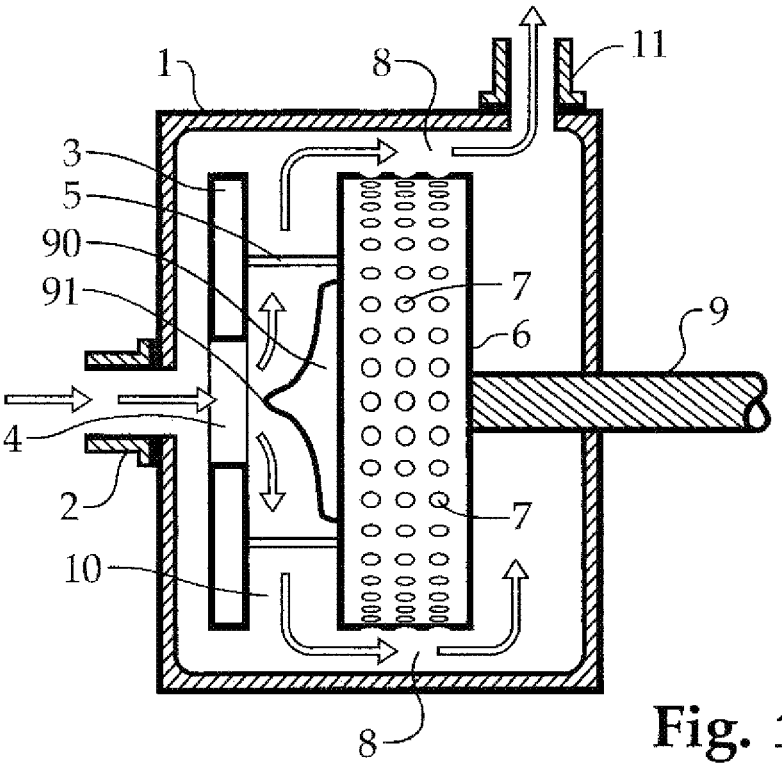
FIG. 13 shows the combination of the axially oriented inlet, flow director, and shaft with the addition of an axially oriented disc.

FIG. 13 is described with many of the same reference numbers as FIG. 1, as it is similar in all respects except that it includes a flow director 90 which is not present in FIG. 1 and which differs somewhat in design from other flow directors described herein. The housing 1 has an inlet conduit 2 and outlet 11. Cavitation rotor 6, having a plurality of cavities 7, is mounted on shaft 9, turned by a motor not shown. Solid disc 3, which has a central hole 4, is fixed to cavitation rotor 6 by disc supports 5 so the disc 3 will rotate with rotor 6. See FIG. 2 for a frontal view of disc 3. Fluid enters through conduit (inlet) 2, passes through hole 4, and immediately strikes the vertex 91 of flow director 90. It is then spread in all directions in distribution space 10 between disc 3 and rotor 6 as indicated by the arrows, continuing into peripheral space 8, which is a cavitation zone. The fluid, now thoroughly mixed and heated, passes through outlet 11 to be conducted to its purpose or storage. Although outlet 11 is vertical as depicted, it may alternatively be oriented tangentially in the direction of flow in peripheral space 8, to reduce possible resistance to the exiting fluid. As implied with respect to FIG. 4, more than one disc may be used in the configuration of FIG. 13. Nevertheless, as with all the other variations of the invention shown herein, conveyance of the fluid to be treated may be assured or assisted by use of a pump upstream of inlet conduit 2.

The use of both a disc (or more than one), to provide a pumping effect, and a flow director oriented toward the incoming fluid, to eliminate the resistance to flow caused by impact on a flat rotor face, and to spread the fluid immediately to the cavitation zone (as illustrated in FIG. 13, results in a highly efficient heating and mixing device.

Thus, our invention includes a cavitation device comprising (a) a cavitation rotor (b) a housing for said cavitation rotor, said housing including an internal surface forming a cavitation zone with said cavitation rotor, (c) a shaft for turning said cavitation rotor, said shaft passing through a wall bearing in an outlet wall of said housing, (d) an inlet in said housing for passing fluid into said housing, said inlet being located in an inlet wall of said housing, to pass said fluid toward the center of said cavitation rotor, (e) a flow director fixed to the center of said cavitation rotor and facing said inlet, said flow director having a profile high in its center and gradually receding therefrom, and (f) an outlet for product, said outlet being located on or near said outlet wall of said housing.

Also, our invention includes a method of heating and mixing fluid in a cavitation device, said cavitation device comprising a cavitation rotor within a housing, a shaft connected to said rotor for turning said rotor, an inlet for introducing fluid into said housing and an exit for delivering mixed and heated fluid product from said cavitation device, comprising (a) feeding fresh fluid to be mixed and heated through said inlet and into said housing to fill up said housing (b) continuing feeding fresh fluid through said inlet and into said housing at a known rate, (c) removing mixed and heated fluid from said exit at said known rate (d) diverting mixed and heated fluid from an outlet between said housing and said exit, at a rate greater than said known rate, and introducing said diverted mixed and heated fluid to said inlet at said rate greater than said known rate.

Our invention also includes an overhung cavitation device comprising (a) a cylindrical rotor having cavities on its periphery (b) a housing for said cylindrical rotor, said housing including an inlet wall, an outlet wall, and an enclosure forming a cylindrical internal surface slightly larger than said cylindrical rotor and forming a cavitation zone therewith, and (c) a shaft for turning said cylindrical rotor, said shaft (i) fixed to said rotor, (ii) passing through a bearing in said outlet wall, and (iii) passing through a cantilever bearing spaced from said outlet wall The invention also includes a cavitation device comprising (a) a housing defining an internal cylindrical surface, said housing also having an inlet side and an outlet side (b) a cavitation rotor having a cylindrical cavitation surface, said cavitation rotor residing within said housing to form a cavitation zone with said internal cylindrical surface, (c) a shaft for turning said rotor, said shaft passing through a bearing in said outlet side, (d) a flow director on said cavitation rotor, said flow director having a central vertex and a generally circular base, and (e) a fluid inlet located on said inlet side, said fluid inlet axially aligned with said central vertex and said shaft.

Our invention also includes an overhung cavitation device comprising (a) a rotor having cavities on its periphery (b) a housing for said rotor, said housing including an inlet side having a fluid inlet, an outlet side, and an enclosure having an internal surface concentric with said rotor and forming a cavitation zone therewith, (c) a flow director on said rotor, said flow director having a vertex and a base on said rotor, said vertex oriented toward said inlet, and (d) a shaft for turning said rotor, said shaft (i) fixed to said rotor, (ii) passing through a bearing in said outlet side, and (iii) passing through a stabilizing cantilever bearing spaced from said outlet side.

And, our invention includes a method of heating and mixing a fluid comprising (a) passing said fluid onto the vertex of a rotating tapered flow director and (b) passing said fluid from said tapered flow director into a cavitation zone between a rotating surface containing cavities and a substantially concentric interior surface of a housing.

The invention claimed is:

1. Method of heating and mixing a fluid comprising (a) passing said fluid onto a rotating tapered flow director, said tapered flow director comprising a central vertex, a tapered surface, and a generally circular peripheral base, so that said fluid is spread from said vertex onto said tapered surface and further spread uniformly on said tapered surface to said peripheral base; and (b) passing said fluid from said peripheral base directly and peripherally into a cavitation zone between a rotating cylindrical surface containing cavities and an interior surface of a housing.

2. The method of claim 1 further including (c) passing said fluid from said cavitation zone to a conduit.

3. The method of claim 1 further including, prior to step (a), passing said fluid to at least one pump disc axially aligned with said vertex of said tapered flow director.

4. A method of heating and mixing a fluid in a cavitation device, said cavitation device comprising (i) a cylindrical rotor having a cylindrical surface and a side, said cylindrical rotor having a tapered flow director fixed on said side and a plurality of dead-end cavities on said cylindrical surface, said tapered flow director including a central vertex, a tapered surface contiguous to said vertex, and a generally circular peripheral base contiguous to said tapered surface and terminating contiguous to or near said cylindrical surface, and (ii) a housing including an interior cylindrical surface substantially concentric with said cylindrical surface of said cylindrical rotor and forming a cavitation zone therewith, said method comprising (a) rotating said cylindrical rotor, (b) passing said fluid onto and in contact with said vertex of said tapered flow director, (c) spreading said fluid from said vertex onto and in contact with said tapered surface of said tapered flow director, (d) further spreading said fluid on and in contact with said tapered surface of said tapered flow director, (e) passing said fluid from said tapered surface of said tapered flow director onto and in contact with said generally circular peripheral base of said tapered flow director, (f) further passing said fluid from said generally circular peripheral base into said cavitation zone, and (g) generating cavitation in said fluid in said cavitation zone.

5. The method of claim 4 further including, in step (f) prior to passing said fluid into said cavitation zone, if said peripheral base terminates at said cylindrical surface, maintaining said fluid in contact with said peripheral base, or, if said peripheral base terminates near said cylindrical surface, maintaining said fluid in contact with said peripheral base and said side of said cylindrical rotor.

6. The method of claim 4 further including, prior to step (a), passing said fluid to at least one pump disc axially aligned with said vertex of said tapered flow director.

* * * * *